US007743555B2

(12) United States Patent
Smith

(10) Patent No.: US 7,743,555 B2
(45) Date of Patent: Jun. 29, 2010

(54) WINDOW REGULATOR

(75) Inventor: Peter J. Smith, Newmarket (CA)

(73) Assignee: Magna Closures Inc., Newmarket, Ontario (CA)

( * ) Notice: Subject to any disclaimer, the term of this patent is extended or adjusted under 35 U.S.C. 154(b) by 880 days.

(21) Appl. No.: 10/541,838

(22) PCT Filed: Dec. 22, 2003

(86) PCT No.: PCT/CA03/01973

§ 371 (c)(1),
(2), (4) Date: Oct. 16, 2006

(87) PCT Pub. No.: WO2004/065738

PCT Pub. Date: Aug. 5, 2004

(65) Prior Publication Data

US 2008/0022601 A1 Jan. 31, 2008

(51) Int. Cl.
*E05F 11/48* (2006.01)

(52) U.S. Cl. ..... 49/352; 49/349; 49/348

(58) Field of Classification Search ..... 49/352, 49/349, 348, 502, 358
See application file for complete search history.

(56) References Cited

U.S. PATENT DOCUMENTS 1,109,574 A * 9/1914 Gates ..... 49/352
1,457,316 A * 6/1923 Price ..... 49/352
3,022,064 A * 2/1962 Russell ..... 49/26
4,970,827 A * 11/1990 Djordjevic ..... 49/349
5,263,282 A * 11/1993 Cooper et al. ..... 49/348
5,309,679 A 5/1994 Ward
5,528,861 A * 6/1996 Beyerlein ..... 49/352
6,050,029 A 4/2000 Simon et al.
6,161,337 A * 12/2000 Morando ..... 49/352
6,796,085 B2 * 9/2004 Smith ..... 49/352

FOREIGN PATENT DOCUMENTS

GB 512273 5/1938

* cited by examiner

*Primary Examiner*—Gregory J. Strimbu
(74) *Attorney, Agent, or Firm*—Clark Hill PLC

(57) ABSTRACT

A window regulator, e.g., for a vehicle window, includes block and pulley arrangements each including a lift pulley mounted to a lift plate that slides along a rail. Operative movement of a crank assembly in a first sense tensions a cable to move the lift plate towards a first end of the rail and operative movement of the crank assembly in a second sense, opposite the first sense, tensions a cable to move the lift plate towards a second end of the rail. The regulator enables the reduction of the operating torque requirements without affecting the packaging of the crank assembly.

5 Claims, 6 Drawing Sheets

WINDOW REGULATOR

FIELD OF INVENTION

The invention generally relates to the field of window regulators, and more particularly to window regulators for automotive applications.

BACKGROUND OF INVENTION

One of the design objectives for window regulating systems, particularly in automotive applications where the regulator controls the vehicle window, is to optimize the operating torque by maximizing the number of crank turns to the limit provided for by specification. In automotive applications, the maximum number of permissible crank turns is generally limited in manual applications to about 6-6.5 turns. Reducing the operating torque reduces the amount of power or manual effort required to raise the window.

Conventionally, operating torque can be reduced by reducing the diameter of the drum which connects the crank to the cable(s) attached to the lift plate. The problem with this solution is that the cable is subject to higher stress because it is wrapped around a smaller diameter. In addition, decreasing the diameter of the drum will increase the number of turns, resulting in a wider drum. This could result in packaging problems since the width of the drum and drum housing must fit within a confined space defined between the inner and outer panels of a vehicle door. In addition, increasing the number of drum turns increases the possibility of ratcheting (i.e., noise) resulting from the cable rubbing against the grooves in the drum, particularly since the cable is routed at a greater angle between its intake position entering the drum housing and the outermost turns of the drum.

An alternative approach to reducing operating torque is to employ a gear reduction system in the drum housing. The problem with this solution is that the extraneous gears typically increase the width of the drum housing, leading to the packaging constraints discussed above. Another problem with gear reduction systems is that they typically require tight tolerances, driving up costs, and backlash is a persistent problem in such systems.

An alternative solution of preferably low cost is desired in order to optimize torque in window regulating systems.

SUMMARY OF INVENTION

In general, the invention employs a pulley 'block and tackle' principle in order to obtain a mechanical advantage for reducing operating torque requirements.

According to one aspect of the invention, a window regulator assembly is provided which has a rail on which a lift plate is mounted to slide. therealong. The lift plate is configured to mountingly receive a window thereto. A lift pulley is rotatably mounted on the lift plate. A first guide pulley and a second guide pulley are respectively mounted near first and second ends of the rail. The assembly has at least one cable that has a first end anchored near the first end of the rail and wound about the lift pulley and thence routed about the first guide pulley to operatively engage a multi-turn cable-guiding rotatable drum, and a second end anchored near the second end of the rail and wound about the lift pulley and thence routed about the second guide pulley to operatively engage the drum. Operative movement of the drum in a first sense tensions the at least one cable to move the lift plate towards the first end of the rail, and operative movement of the drum in a second sense, opposite the first sense, tensions the at least one cable to move the lift plate towards the second end of the rail.

The window regulator preferably employs two cables anchored to the drum and disposed to wind around the drum. The first cable is fixed near the first end of the rail, thence wound around the lift pulley to the first guide pulley, and thence routed to the drum. The second cable is fixed near the second end of the rail, thence wound around the lift pulley to the second guide pulley, and thence routed to the drum. The motive power for rotating the drum may be provided via a hand crank or an electric actuator such as a motor.

According to another aspect of the invention, a dual-rail window regulator assembly is provided having first and second rails; first and second lift plates respectively slidingly mounted to the first and second rails; first and second lift pulleys respectively slidingly mounted to the first and second lift plates; and first and second guide pulleys (140A, 140B) respectively mounted near first and second ends of the first and second rails. At least one cable has a first end anchored near the first rail end and wound about the first lift pulley of the first rail and thence routed about the first guide pulley to operatively engage a rotatable multi-turn, cable-guiding drum. A second end of the least one cable is anchored near the second rail end and wound about the second lift pulley of the second rail and thence routed about the second guide pulley to operatively engage the drum. Additional means, such as a third cable, interconnect the first and second lift plates. The operative movement of the drum in a first sense tensions the at least one cable to move the first and second lift plates towards the first rail end, and operative movement of the drum in a second sense, opposite the first sense, tensions the at least one cable to move each lift plate towards the second rail end.

According to another, more general aspect of the invention, a window regulator assembly is provided which includes at least one rail, a lift plate slidingly mounted on each rail, and a lift pulley mounted to each lift plate. A first guide pulley is mounted near a first end of the at least one rail, which represents a one end of window travel (e.g., the open position). A second guide pulley is mounted near an opposing second end of the at least one rail, which represents another end of window travel (e.g., the closed position). A cable, which may be provided in one or more segments, has a first end anchored near the first rail end and wound about the lift pulley associated with the rail presenting said first rail end and thence routed about the first guide pulley. A second, end of the cable is anchored near the second rail end and wound about the lift pulley associated with the rail presenting said second rail end and thence routed about the second guide pulley. A drive means is provided for tensioning and translating the cable. Actuating the drive means in a first sense tensions the cable to move each lift plate towards the first rail end, and actuating the drive means in a second sense, opposite the first sense, tensions the cable to move each lift plate towards the second rail end.

The drive means may include a multi-turn cable-guiding drum powered by a hand crank or motor. Alternatively, at least one of the guide pulleys may be connected to a hand crank or motor and include a multi-turn cable guide for winding and unwinding the cable thereon, thus reducing the part count.

Another broad aspect of the invention relates to replacing a guide pulley in a window regulating system with a drive pulley having a multi-turn cable guide for winding and unwinding a cable thereon, and driving such a pulley with an external drive.

BRIEF DESCRIPTION OF DRAWINGS

The foregoing and other aspects of the invention will become more apparent from the following description of illustrative embodiments thereof and the accompanying drawings, which illustrate, by way of example, the principles of the invention. In the drawings.

DETAILED DESCRIPTION OF PREFERRED EMBODIMENTS

Figure 1:
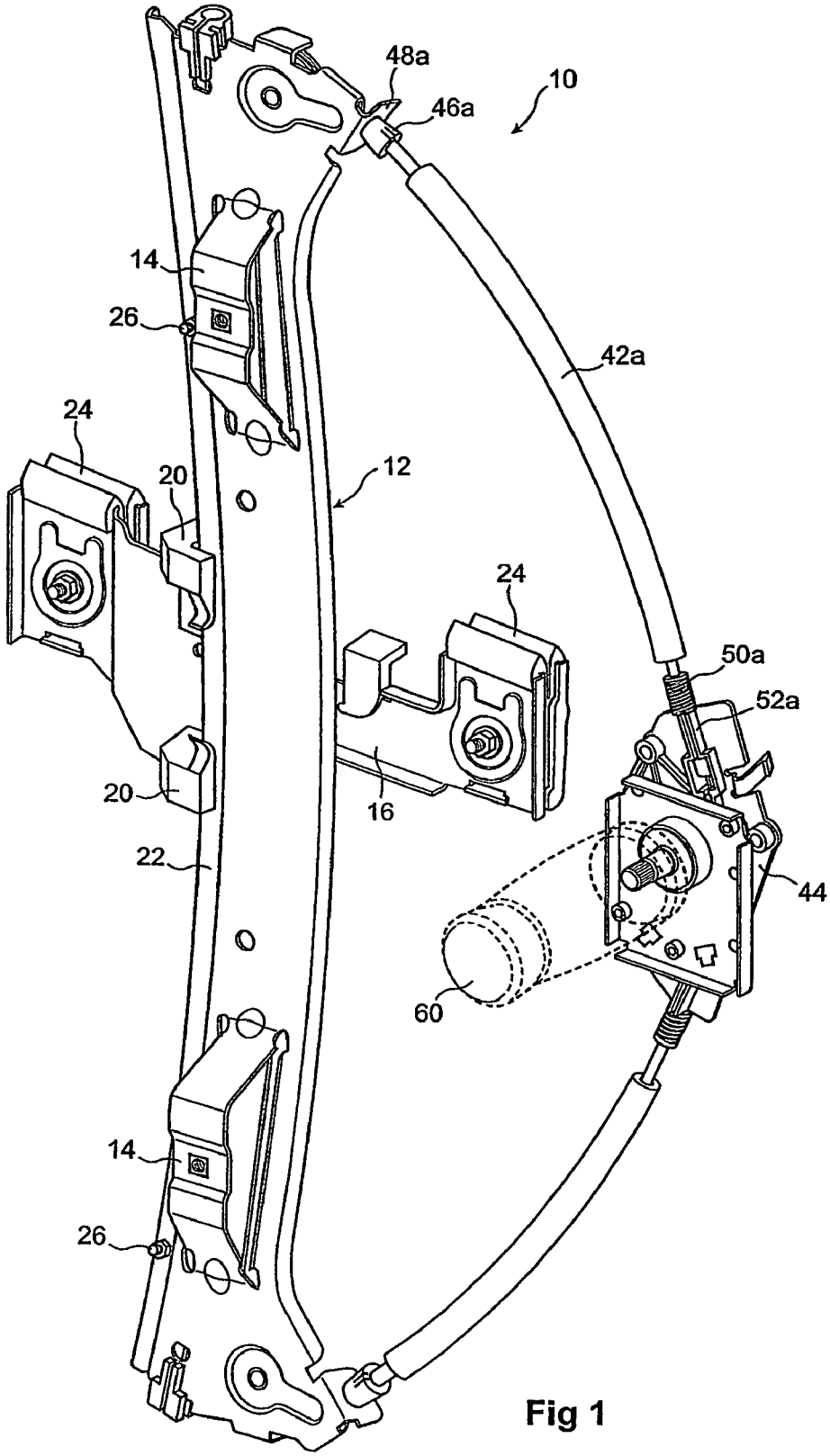
FIG. 1 is a perspective view of one side of a window regulator according to a first exemplary embodiment.
Figures 2, 2B:
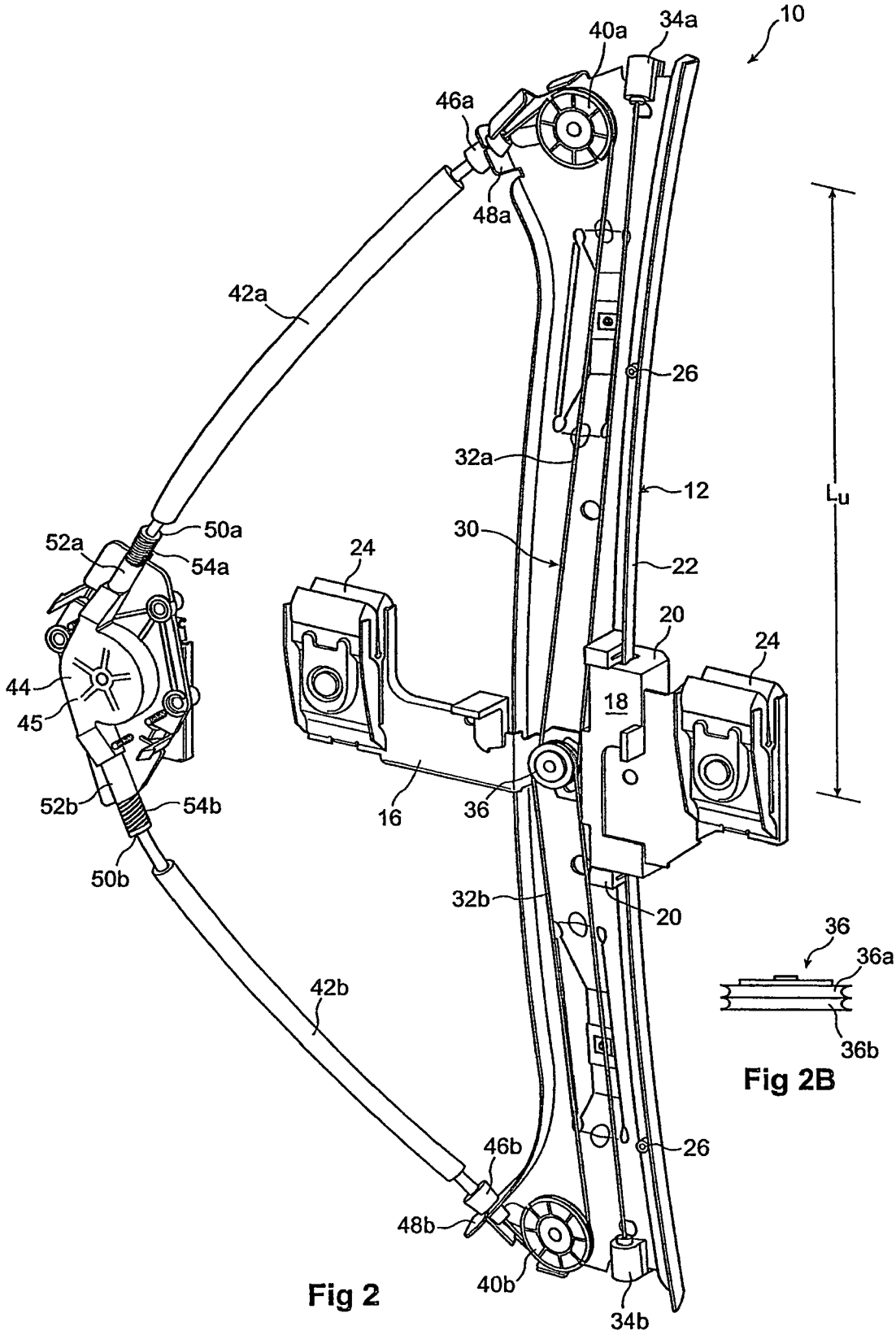
FIG. 2 is a perspective view of the opposite side of the window regulator shown in FIG. 1.
FIG. 2B is an isolated end view of a rivet pulley employed in the window regulator shown in FIG. 1.

FIGS. 1 and 2 show a window regulator 10 according to a first exemplary embodiment. The regulator 10 comprises a rail assembly 12 which is mountable to the vehicle door structure via integrally formed brackets 14. A lift plate 16 including a plastic guide 18 is mounted to the rail assembly 12. More particularly, the guide 18 includes slotted tabs 20 which slidingly ride along flanges 22 formed along the edges of the rail assembly 12. The lift plate 16 includes rubber-tipped clamps 24 for mounting the vehicle window (not shown) thereto. Stops 26 define the upper and lower limits of travel for the lift plate 16, and hence the maximum distance traversed by the vehicle window.

Figure 3:
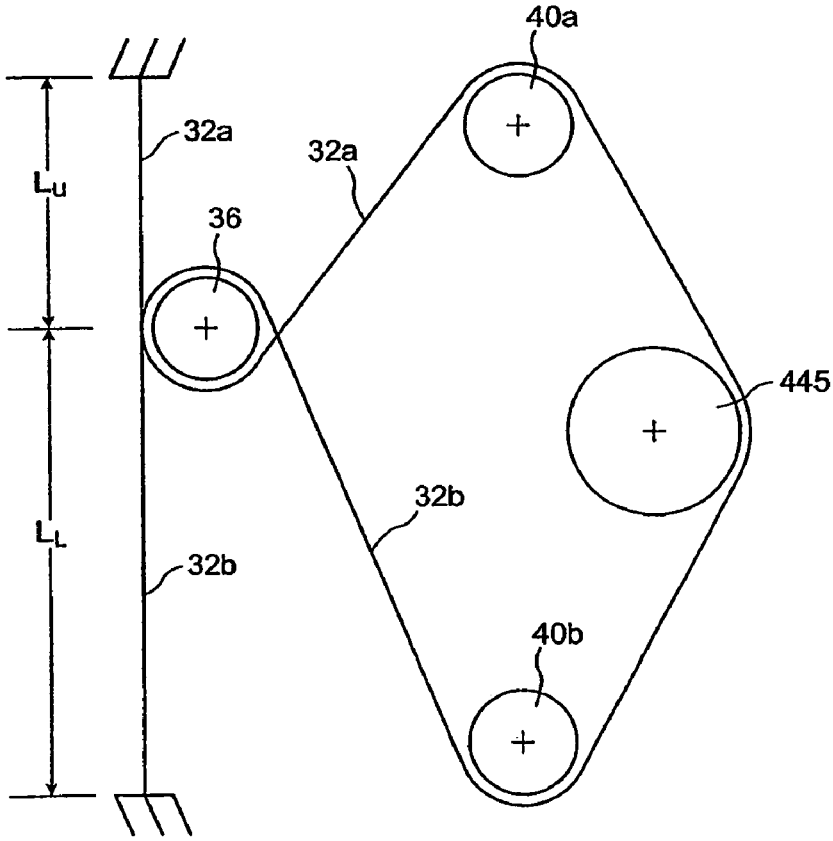
FIG. 3 is a schematic diagram of a pulley system, shown in isolation, which is employed in the window regulator shown in FIG. 1 to provide a 2:1 mechanical advantage.

The lift plate 16 is regulated by a pulley system 30, shown in isolation in FIG. 3, which comprises an upper cable 32*a* and a lower cable 32*b*. The upper cable 32*a* is anchored to the top of the rail assembly 12 by an anchor 34*a*. The upper cable 32*a* is routed around a pulley rivet or lift pulley 36. The lift pulley 36 is preferably rotatably mounted to the lift plate 16 and features two independent (i.e., non-spiraling) grooves 38*a*, 38*b*, as detailed in FIG. 2B. The upper cable 32*a* is routed around one of the grooves 38*a*, 38*b* and back up to an upper guide pulley 40*a* which is rotatably mounted to the top of the rail assembly 20. From the guide pulley 40*a* the upper cable 32*a* is routed through a first conduit 42*a* and attached to a crank assembly 44. The crank assembly 44 includes a multi-turn cable-guiding drum 445 (not explicitly shown in FIGS. 1 & 2) as well known in the art per se which is mounted in the housing 45 of the assembly 44. The upper cable 32*a* is anchored to the drum and, depending on whether or not the limit of travel has been reached, partially wound around the drum.

The conduit 42*a* is mounted to the rail assembly 12 by a conduit socket 46*a* mounted in a receptacle 48*a* formed in the rail assembly. Another conduit socket 50*a* is mounted to an intake tube 52*a* of the housing 45, and a torsion spring 54*a* is provided to maintain tension on the upper cable 32*a*.

The lower cable 32*b* is routed in a similar manner. The lower cable 32*b* is anchored to the bottom of the rail assembly 12 by an anchor 34*b* and routed around the other of the grooves 38*a*, 38*b* of the lift pulley 36. From the lift pulley 36 the lower cable 32*b* is routed around back down to lower guide pulley 40*b* which is fixed to the bottom of the rail assembly 20. From the guide pulley 40*b* the lower cable 32*b* is routed through a second conduit 42*b* and attached to the multi-turn cable-guiding drum of the crank assembly 44.

The second conduit 42*b* is mounted to the rail assembly 12 by a second conduit socket 46*b* mounted in a second receptacle 48*a* formed in the rail assembly. A second conduit socket 50*b* is mounted to a second intake tube 52*b* of the housing 45, and a second torsion spring 54*b* is provided to maintain tension on the lower cable 32*b*.

Figure 4:
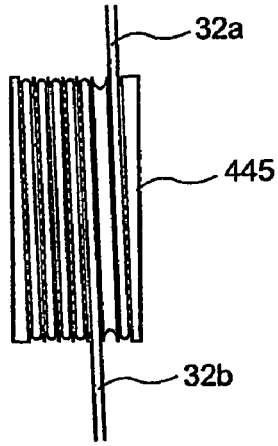
FIG. 4 is an isolated view of a cable-winding drum employed in the window regulator shown in FIG. 1.

A handle 60 (shown in phantom) is attached to the crank assembly 44. Rotating the handle 60 causes the cable-guiding drum 445, shown in isolation in FIG. 4, to rotate. The drum 445 converts rotational motion to linear motion so as the drum 445 rotates, the cables 32*a*, 32*b* which are wound around the drum, are translated. More particularly, as the drum 445 rotates, one of the upper and lower cables 32*a*, 32*b* spools onto the drum while the other cable correspondingly spools off the drum, i.e., one cable winds onto the drum while another cable winds off the drum.

As the drum rotates, the length $L_u$ of one of the cables 32*a*, 32*b* as measured along the rail flange 22 increases with a corresponding decrease in the length $L_l$ of the other cable as measured along the rail flange. In conjunction, the lift pulley 36 travels up or down depending on which cable increases its length along the rail. Note that as a result of the pulley system, the lift pulley 36, and hence the vehicle window, travels at substantially half the speed of the cables, yielding a 2:1 mechanical advantage and thus a 2:1 reduction in motive torque requirements. This is shown also in the exaggerated schematic diagram of FIG. 3.

It is desirable to have both upper and lower cables 32*a*, 32*b* wrapped around the lift pulley 36 from opposing directions in a symmetrical arrangement. Note that one of the cables, e.g., cable 32*a*, is routed in a 'block and tackle' arrangement and, being under tension, presents a force acting upwards on the pulley rivet 36 and lift plate 16. The other cable, e.g., cable 32*b*, is also routed in a block and tackle arrangement and, being under tension, presents a force acting downwardly on the pulley rivet 36 and lift plate 16. The upward and downward forces are preferably selected so as to be substantially equal.

Figure 5A:
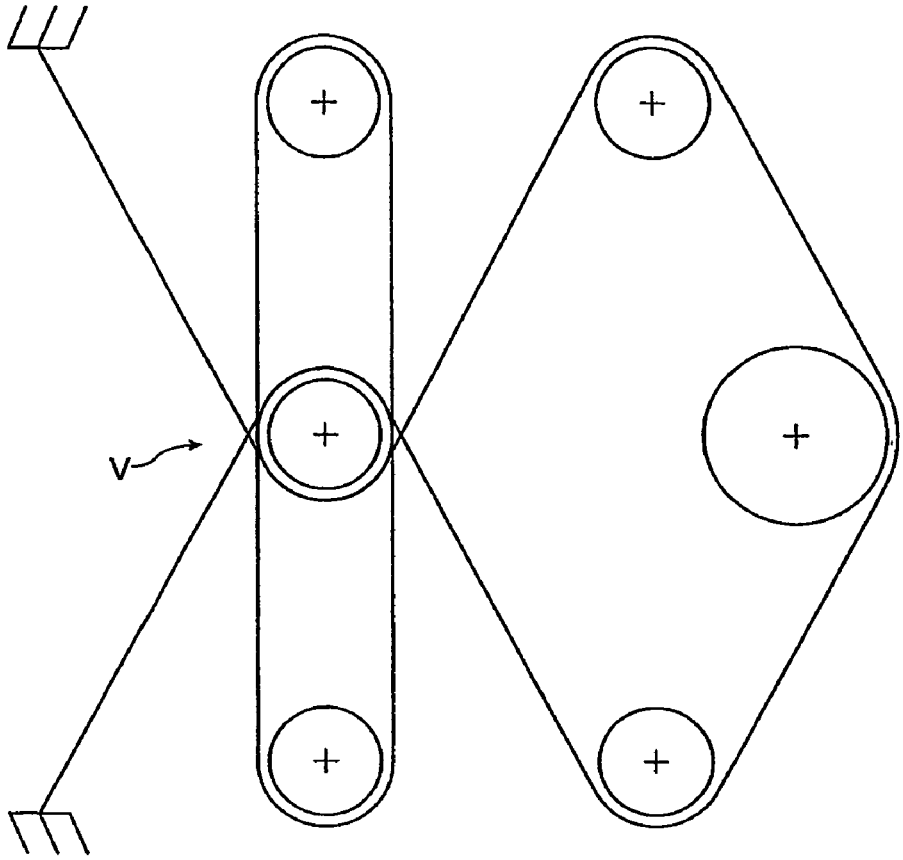
FIGS. 5A and 5B are schematic diagrams of a pulley system according to an alternative embodiment which yields a 4:1 mechanical advantage.
Figure 5B:
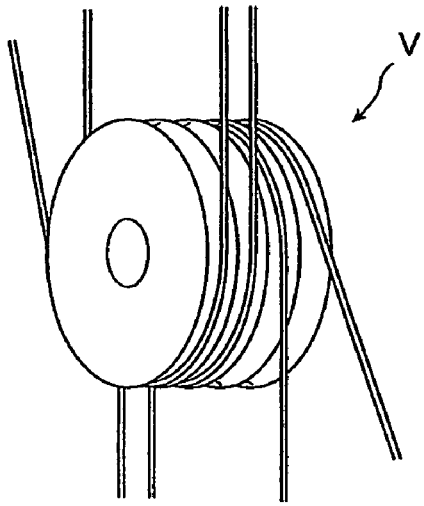

The pulley block and tackle principle can be applied to yield other mechanical advantage ratios. For example, FIG. 5A shows, in schematic form, an alternative embodiment which provides a 4:1 mechanical advantage. FIG. 5B is a perspective view of the lift pulley of this embodiment, taken in isolation, showing the cable routing about the lift pulley.

Figure 6:
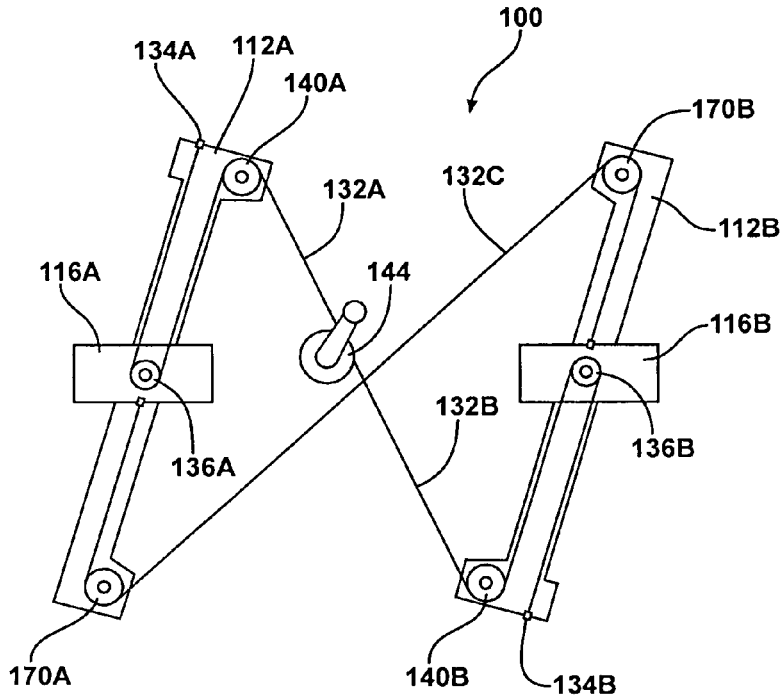
FIG. 6 is a schematic diagram of a window regulator according to a second exemplary embodiment, which employs dual rails and dual lift plates.

FIG. 6 shows, in schematic form, a second exemplary embodiment of a window regulator 100 which employs two rails 112A and 112B having two lifter plates 116A, 116B respectively glidingly connected thereto. First and second cables 132A and 132B are attached to and spool to/from a multi-turn cable-guiding drum (not shown) of a crank assembly 144. In this embodiment, the first cable 132A, which is anchored to the top of the first rail 112A at 134A, extends around a lift plate pulley 136A rotatably mounted to lift plate 116A, and thence around a pulley 140A rotatably mounted to the top of rail 112A to the crank assembly 144. In a similar manner, the second cable 132B is anchored to the bottom of the second rail 112B at 134B, extends around a lift plate pulley 136B rotatably mounted to lift plate 116B, and thence around a pulley 140B rotatably mounted to the bottom of rail 112B to the crank assembly 144. Thus, the pulley rivet 36 of the first embodiment is essentially replaced by the two pulleys 136A, 136B. A third cable 132C wrapped around pulleys 170A, 170B respectively mounted to rails 112A, 112B interconnects the two lift plates 116A, 116B together. In operation, as the crank assembly 144 is rotated, the lifter plates 116A, 116B and hence the window travels at half the speed of cables 132A, 132B yielding a 2:1 mechanical advantage.

It will be understood that while the embodiments described above have employed at least two cables, a single cable could be wound around the drum and used to translate the pulley rivet or lifter plate(s). In addition, while the embodiments discussed above have shown a manually activated crank assembly, it will be understood that other drive means can be provided for tensioning and translating the cable, such as a motor operatively coupled to a multi-turn drum cable or other electromechanical actuator providing the motive torque for actuating the regulator.

Figure 7:
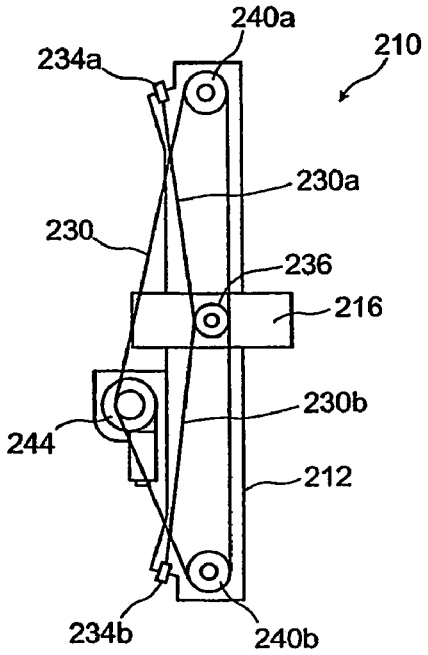
FIG. 7 is a schematic diagram of a window regulator according to a third exemplary embodiment, which employs conduit-less cables.
Figure 7B:
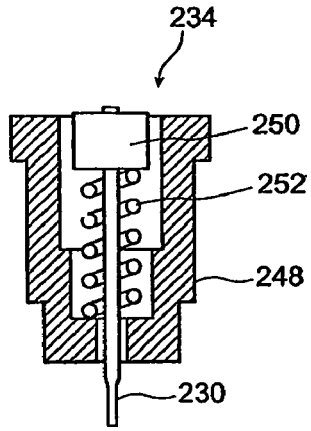
FIG. 7B is cross-sectional view of an anchor, taken in isolation, employed in the window regulator shown in FIG. 7.

Furthermore, while the cable shown in the embodiments discussed above is sheathed in conduits, it will be appreciated that a conduit-less window regulator system is also contemplated. For example, FIG. 7 shows a window regulator system 210 having a rail 212, a lift plate 216 mounted to slide along the rail 212; a lift pulley 236 mounted to the lift plate 216; a cable 230; and first and second guide pulleys 240*a*, 240*b* respectively mounted near first and second ends of the rail 212. The cable 230 has a first end anchored (via anchor 234*a*) near the first end of the rail 212 and is wound about the lift pulley 236 and thence routed about the first guide pulley 240*a*. A second end of the cable 230 is anchored (via anchor 234*b*) near the second end of the rail 212 and wound about the lift pulley 236 and thence routed about the second guide pulley 240*b*. FIG. 7B is a cross-sectional view of anchor 234 which includes a socket 248 mounted in an aperture of the rail 212. The cable 230 has a nipple 250 mounted at the end thereof. The nipple 250 enables the cable 230 to receive tensioning forces provided by a spring 252. No cable conduits are employed.

The cable 230 extends between the first and second guide pulleys and is preferably provided in two separate segments, 230*a* and 230*b*, each of which is anchored to or otherwise connected to a cable drive means, such as a motor-driven cable guiding drum 244. Actuation of the drive means in a first sense tensions the cable to move the lift plate towards the first end of the rail, and actuation of the drive means in a second sense, opposite the first sense, tensions the cable to move the lift plate towards the second end of the rail. Note that in this embodiment, each cable segment is wrapped around the pulleys or drum in one direction only, thus eliminating "reverse bending" of the cable and the risk of premature fatigue.

Figure 8:
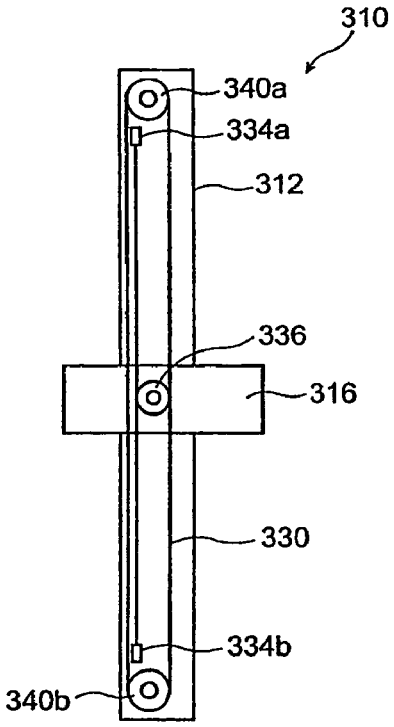
FIG. 8 is a schematic diagram of a window regulator according to a third exemplary embodiment, which has a reduced part count.

It should also be appreciated that one of the pulleys employed in any of the above-described embodiments can be replaced with a cable-guiding drum, i.e., one of the pulleys can be a drive pulley. For example, FIG. 8 shows a conduit-less window regulator system 310 having a rail 312, a lift plate 316 mounted to slide along the rail 312; a lift pulley 336 mounted to the lift plate 316; a cable 330; and first and second guide pulleys 340*a*, 340*b* respectively mounted near first and second ends of the rail 312. The cable 330 has a first end anchored (via anchor 334*a*) near the first end of the rail and is wound about the lift pulley 336 and thence routed about the first guide pulley 340*a*. A second end of the cable 330 is anchored (via anchor 334*b*) near the second end of the rail and wound about the lift pulley 336 and thence routed about the second guide pulley 340*b*. The cable 330 extends linearly between the first and second guide pulleys. In this embodiment, the second pulley has a multi-turn spiraling groove on the outside diameter thereof and is drivingly connected to a motor, thus providing an alternative drive means for translating the cable. Actuation of the drive means in a first sense tensions the cable to move the lift plate towards the first end of the rail, and actuation of the drive means in a second sense, opposite the first sense, tensions the cable to move the lift plate towards the second end of the rail. The principle advantages provided by this embodiment are a reduced part count and a very narrow lateral profile.

Those skilled in the art will appreciate that a variety of other modifications may be made to the embodiments disclosed herein without departing from the spirit of the invention.

The invention claimed is:

1. A window regulator assembly comprising:

first and second rails (112A, 112B), each of said first and second rails extending between a first end and a second end thereof;

first and second lift plates (116A, 116B) respectively slidingly mounted to said first and second rails;

at least one primary cable (132A, 132B);

a secondary cable;

a first guide pulley mounted to said first end of said first rail;

a second guide pulley mounted to said second end of said second rail;

a third guide pulley mounted to said second end of said first rail;

a fourth guide pulley mounted to said first end of said second rail;

a drum (144);

a first lift pulley mounted to said first lift plate;

a second lift pulley mounted to said second lift plate;

wherein said at least one primary cable has a first end anchored (134A) directly to said first rail near said first end of said first rail and wound about said first lift pulley (136A) and thence routed about said first guide pulley (140A) and then operatively engaging said drum (144), and a second end anchored (134B) directly to said second rail near said second end of said second rail and wound about said second lift pulley (136B) and thence routed about said second guide pulley (140B) and then operatively engaging said drum (144), and wherein said secondary cable is anchored to said first lift plate and then routed about said third guide pulley and thence routed about said fourth guide pulley and then anchored to said second lift plate interconnecting said first and second lift plates;

whereby operative movement of said drum in a first sense tensions said at least one primary cable to move said first and second lift plates towards said first ends of said first and second rails, and operative movement of said drum in a second sense, opposite said first sense, tensions said at least one primary cable to move said first and second lift plates towards said second ends of said first and second rails.

2. A window regulator assembly according to claim 1, wherein said at least one primary cable comprises a first primary cable having said first cable end and a second primary cable having said second cable end, the other ends of said first and second primary cables being attached to said drum.

3. A window regulator assembly according to claim 1, wherein said first and second lift pulleys are rotatably mounted to said first and second lift plates, respectively.

4. A window regulator assembly according to claim 1, wherein said first guide pulley is rotatably mounted to said first end of said first rail and said second guide pulley is rotatably mounted to said second end of said second rail.

5. A window regulator assembly comprising:

a rail (312), a lift plate (316) mounted to slide along the rail;

at least one cable; and first and second guide pulleys (340*a*, 340*b*) respectively mounted to first and second ends of the rail;

characterized by a lift pulley (336) mounted to the lift plate;

the at least one cable having a first end anchored (334*a*) directly to the rail near the first end of the rail and then wound about the lift pulley (336) and thence routed about the first guide pulley (340*a*), a second end (34*b*) anchored directly to the rail near the second end of the rail and then wound about the lift pulley (336) and thence routed about the second guide pulley (340*b*), the at least one cable extending linearly between the first and second guide pulleys; and wherein at least one of the first and second guide pulleys (340*a*, 340*b*) is connected to a means for rotating said at least one of the pulleys and includes a multi-turn cable guide for winding and unwinding the at least one cable, whereby rotation of said at least one of the pulleys in a first sense tensions the at least one cable to move the lift plate towards the first end of the rail, and rotation of said at least one of the pulleys in a second sense, opposite said first sense, tensions the at least one cable to move the lift plate towards the second end of the rail.

* * * * *